United States Patent [19]

Asik et al.

[11] Patent Number: 4,471,741

[45] Date of Patent: Sep. 18, 1984

[54] STABILIZED THROTTLE CONTROL SYSTEM

[75] Inventors: Joseph R. Asik, Bloomfield Hills; Jody M. Kirsch, Livonia, both of Mich.

[73] Assignee: Ford Motor Company, Dearborn, Mich.

[21] Appl. No.: 450,931

[22] Filed: Dec. 20, 1982

[51] Int. Cl.[3] ..... F02D 9/00

[52] U.S. Cl. ..... 123/478; 123/480; 123/489

[58] Field of Search ..... 123/488, 489, 376, 480, 123/478, 389, 361

[56] References Cited

U.S. PATENT DOCUMENTS 3,771,504 11/1973 Woods ..... 123/444
4,138,979 2/1979 Taplin ..... 123/436
4,168,679 9/1979 Ikeura et al. ..... 123/489 X
4,184,461 1/1980 Leug ..... 123/488 X

*Primary Examiner*—William A. Cuchlinski, Jr.
*Attorney, Agent, or Firm*—Peter Abolins; Robert D. Sanborn

[57] ABSTRACT

The rate of change of throttle position in an internal combustion engine is used to stabilize throttle response when controlling the throttle to a desired position in response to a fuel demand. A constant voltage is generated which controls the throttle position to achieve a direct level of manifold absolute pressure. The constant voltage is equal to the difference between a command voltage representing a desired manifold absolute pressure and a feedback voltage which is the sum of a first product of a first constant and a voltage representing actual manifold absolute pressure and of a second product of a second constant and a voltage representing throttle velocity.

6 Claims, 6 Drawing Figures

IGNITION CONTROL STRATEGY

STABILIZED THROTTLE CONTROL SYSTEM

BACKGROUND OF THE INVENTION

1. Field of the Invention

This invention relates to the control of an internal combustion engine.

2. Prior Art

U.S. Pat. No. 4,138,979 issued to Taplin teaches an electronically controlled closed loop system for maintaining a desired air/fuel ratio in an internal combustion engine. The operator positioned accelerator commands a given fuel flow, and the flow of air is controlled by means of a servo actuated throttle plate. The commanded fuel flow and the position of the throttle plate are provided as inputs to an electronic control unit, and these inputs are used to generate a basic command signal for controlling the servo motor to adjust the position of the throttle plate. The electronic control unit has an input from a manifold absolute pressure sensor. However, there is no discussion in the Taplin patent of stabilization of the throttle position.

U.S. Pat. No. 3,771,504 issued to R. L. Woods also teaches regulating an air/fuel mixture ratio in a fuel delivery system by scheduling air flow as a function of the operator's selected fuel flow. This is in contrast to other conventional systems wherein fuel flow is scheduled as a function of the operator's selected air flow. However, in the Woods patent, fluidic technology is used for the sensing, computation and actuation of the required variables. Again, there is no teaching of achieving throttle stability.

SUMMARY OF THE INVENTION

This invention teaches a throttle control system which can be applied in an automatic engine air control system. Automatic engine air control systems have been recognized as having high potential for leading to significant improvements in engine and vehicle drivability and emissions. One of the difficulties in implementing this concept, however, is providing stable throttle valve position. This is particularly difficult under closed loop operation in which the main feedback variable has excessive time delay and response time, such as air fuel ratio control in the presence of an engine transport delay. The subject invention accomplishes this without the use of complex algorithms to determine the required throttle angle as a function of rpm, fuel flow, and manifold absolute pressure.

This invention recognizes that by using a combination of signals representing throttle velocity (i.e., the rate of change of throttle position) and manifold absolute pressure as a composite feedback signal to an electronic control unit to control throttle position a desired stable level of intake manifold absolute pressure is achieved. Using intake manifold absolute pressure feedback voltage without throttle velocity as a negative feedback signal leads to throttle position instability because of the inherent lags in the response of intake manifold absolute pressure to changes in the throttle valve position. For example, such lags occur when the throttle is opened and intake manifold absolute pressure lags because of the manifold filling effect. It takes about 10–100 milliseconds for intake manifold absolute pressure to reach a new steady state value after a step change in throttle position. Also, a lag can occur when the throttle is closed. In this case, intake manifold absolute pressure lags because of the manifold pump-down effect. That is, it takes several engine cycles, approximately 100 milliseconds, to pump the intake manifold down to its new equilibrium value. Such inherent delays lead to throttle valve instability when using only intake manifold absolute pressure as an indication of desired throttle position.

DETAILED DESCRIPTION OF THE INVENTION

Figure 1:
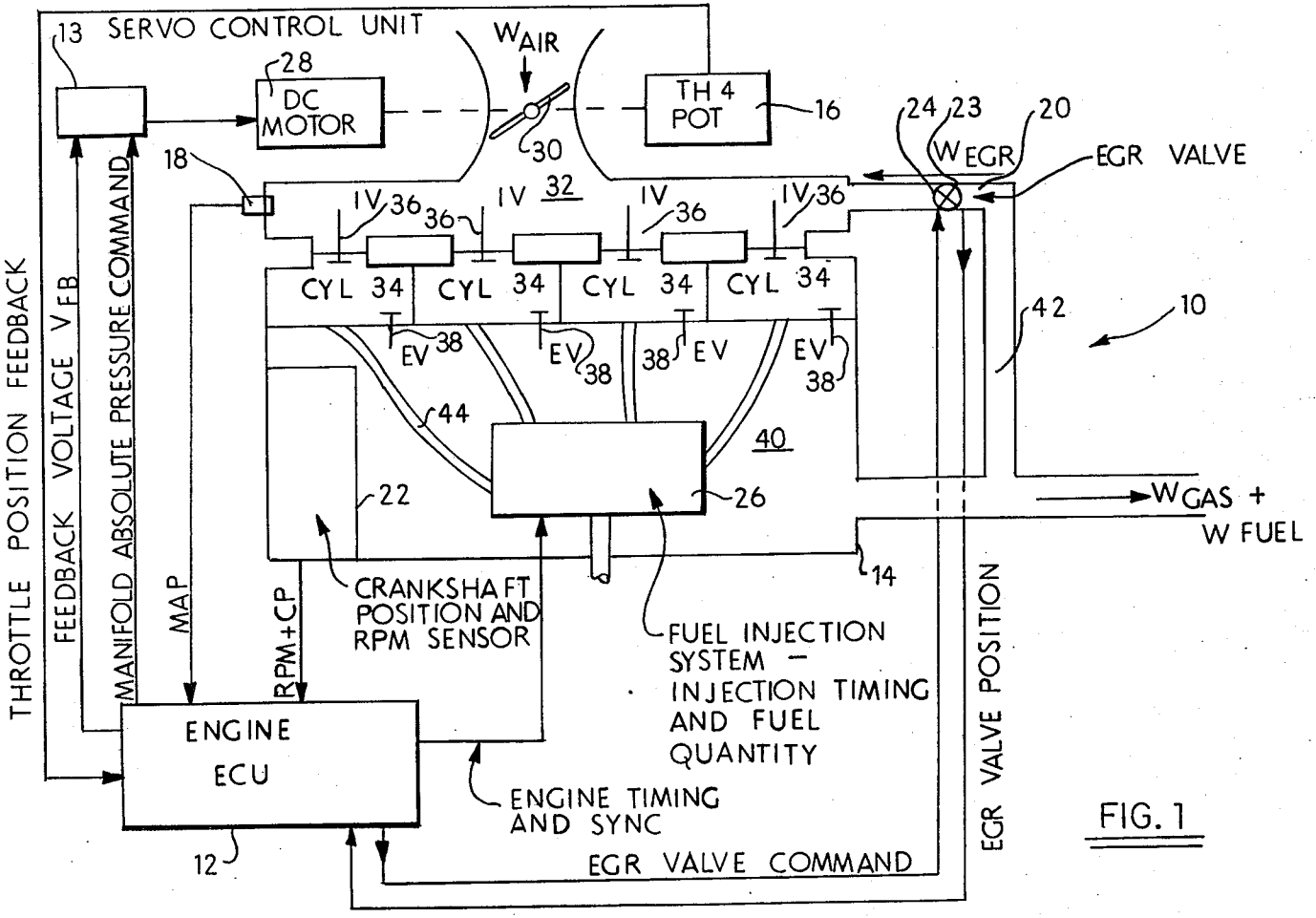
Fig. 1 is a block and schematic diagram of a control system in accordance with an embodiment of this invention.

Referring to FIG. 1, throttle control system 10 includes an engine electronic control unit 12 which is coupled to an engine 14. Providing inputs to electronic engine control 12 are throttle position sensor 16, manifold absolute pressure sensor 18, exhaust gas recirculation valve position sensor 20, and crankshaft position and revolution per minute sensor 22. Outputs from electronic engine control unit 12 are applied to exhaust gas recirculation valve actuator 24, fuel injection system 26, and throttle actuator motor 28. Air passes through a throttle 30 to an intake manifold 32 which is connected to a plurality of cylinders 34 by intake valves 36. A plurality of exhaust valves 38 connect cylinders 34 to an exhaust manifold 40 which is connected by a passage 42 to exhaust gas recirculation valve 20. Fuel injection system 26 includes fuel supply lines 44 which supply fuel to cylinders 34.

Figure 2:
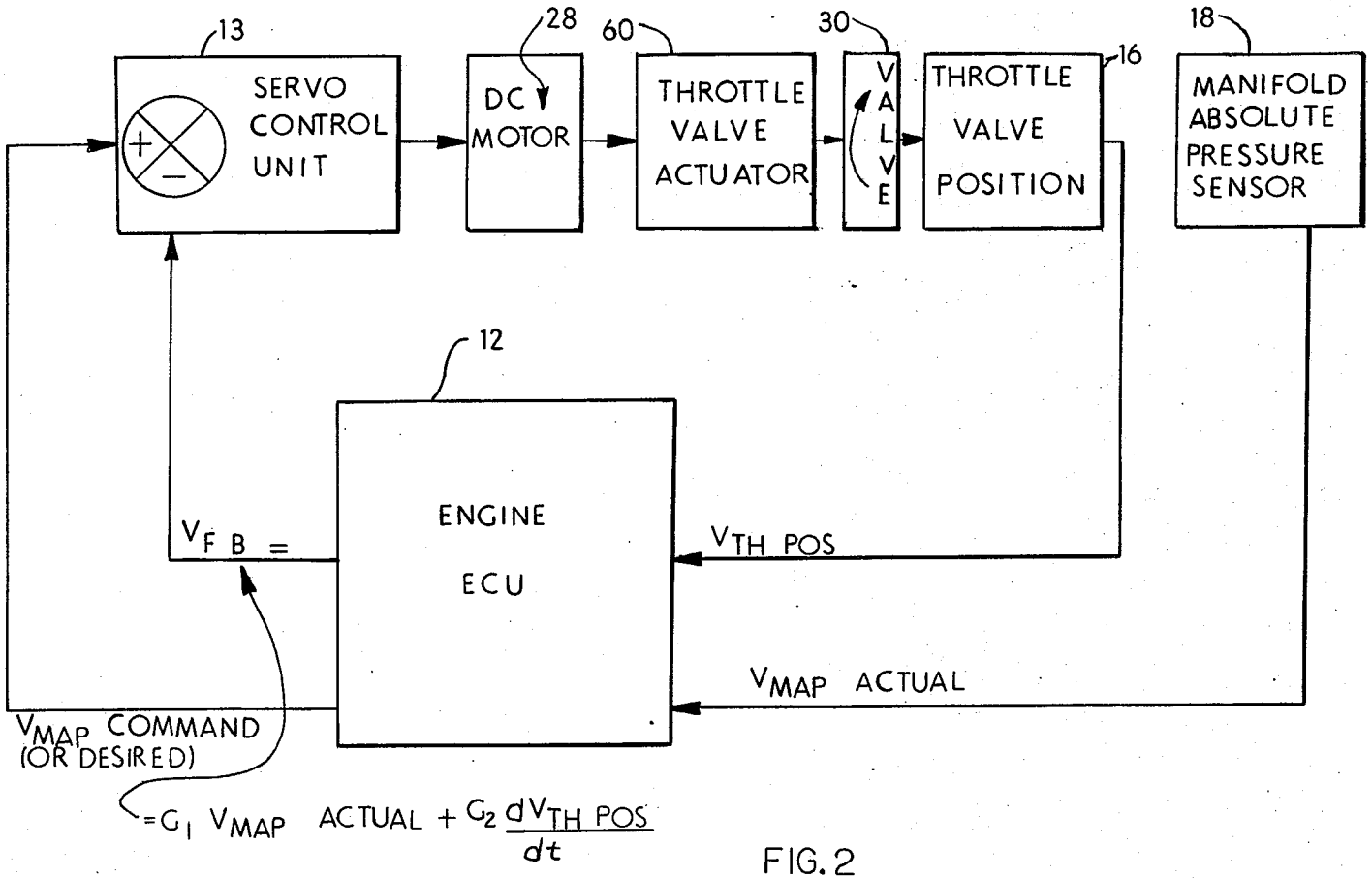
FIG. 2 is a logic block diagram of a control system in accordance with an embodiment of this invention.

Referring to FIG. 2, a portion of the signal flow of FIG. 1 is shown in greater detail. In particular the signal flow in FIG. 1, from engine electronic control unit (ECU) 12 to DC motor 28 is shown to include servo control unit 13.

Referring to FIG. 2, engine electronic control unit 12 receives signals representing the actual manifold absolute pressure and throttle position. Electronic control unit 12 generates a feedback voltage based on actual MAP and throttle velocity. Electronic control unit 12 supplies two voltages representing the desired or commanded value of MAP and the feedback voltage to servo control unit 13. To this end, manifold absolute pressure sensor 18 is connected as an input control unit 12. Also, a throttle position sensor 16 is connected as an input to control unit 12. The output of servo control unit 13 is applied to a DC motor 28 which in turn is coupled to a throttle valve actuator 60 which positions throttle valve 30. Throttle valve position sensor 16 is coupled to throttle valve 30. Thus, as far as signal flow goes, throttle valve 30 is coupled between throttle valve actuator 60 and throttle valve position sensor 16. In operation, the feedback voltage output ($V_{FB}$) from control unit 12 is computed as a function of the equation:

$$V_{FB} = G_1 V_{MAP\ ACTUAL} + G_2 \frac{d(V_{TH\ POS})}{dt}$$

where $V_{TH\ POS}$ represents the throttle valve position voltage, $V_{MAP}$ Actual is a measured MAP voltage, and $G_1$, $G_2$ are gain constants.

When using direct fuel control, fuel quantity, which is directly related to engine torque for an engine operating with excess air (lean A/F), becomes the independent variable and the remaining control variables are scheduled accordingly. An intake manifold absolute pressure signal is provided to electronic engine control unit 12. The throttle angle is continuously adjusted to produce the desired MAP as calculated in accordance with a model of engine operation.

Figure 3:
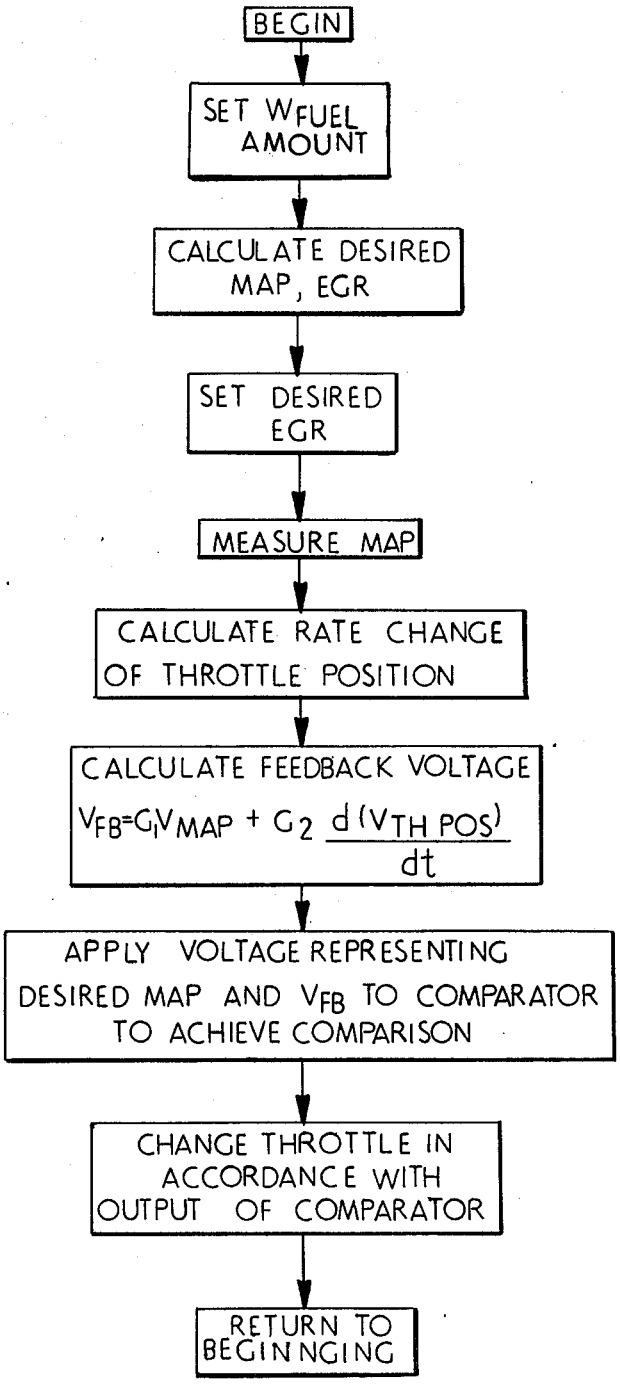
FIG. 3 is a logic flow diagram of an engine air fuel control system using a throttle stabilizing method in accordance with an embodiment of this invention.

Referring to FIG. 3, the sequence of calculations starts with a measurement of accelerator position and thus the amount of fuel entering the engine. The engine control strategy of control unit 12 determines the desired MAP and EGR. Engine control unit 12 also calculates the desired amount of exhaust gas recirculation entering the engine, $W_{EGR}$, in accordance with engine strategy of engine control unit 12. The throttle angle is adjusted to provide this desired MAP. The adjustment of the throttle angle to provide the desired MAP is accomplished by measuring MAP, calculating the rate of change of throttle position, calculating the feedback voltage, and applying voltages representing the desired MAP and the feedback voltage to a comparator. The comparator provides an output which causes a change in throttle position to occur that results in the desired MAP.

Figure 4:
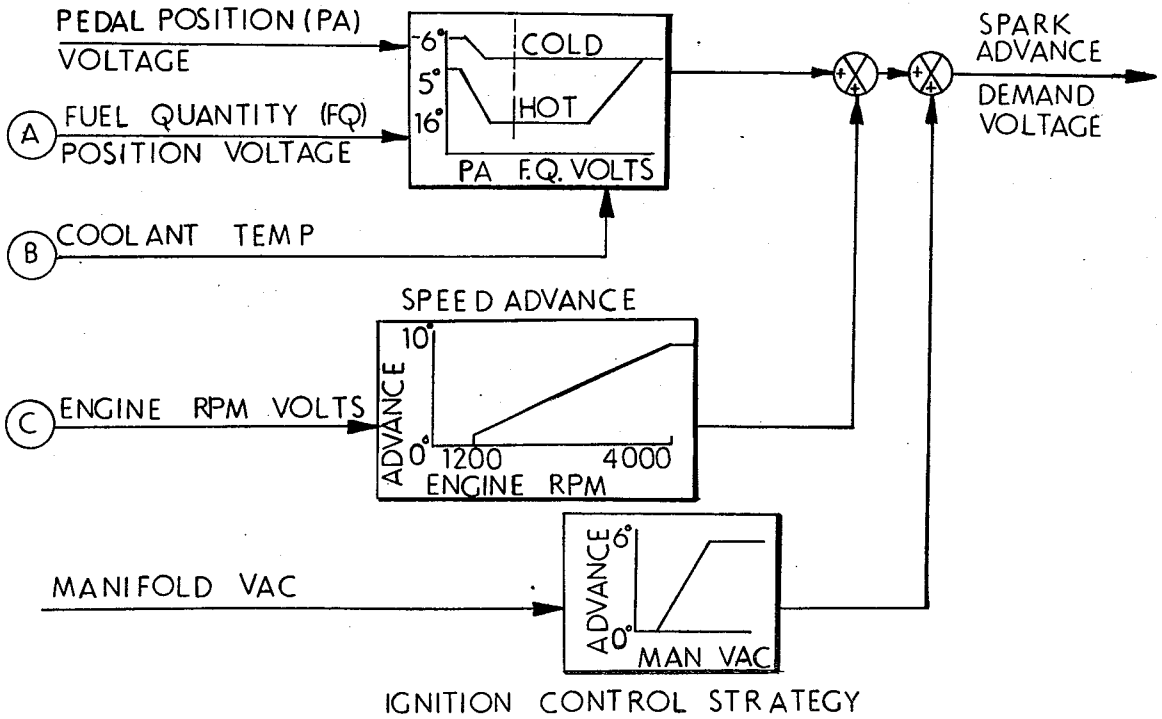
FIG. 4 is a logic block diagram of a direct fuel control system for ignition strategies.
Figure 5:
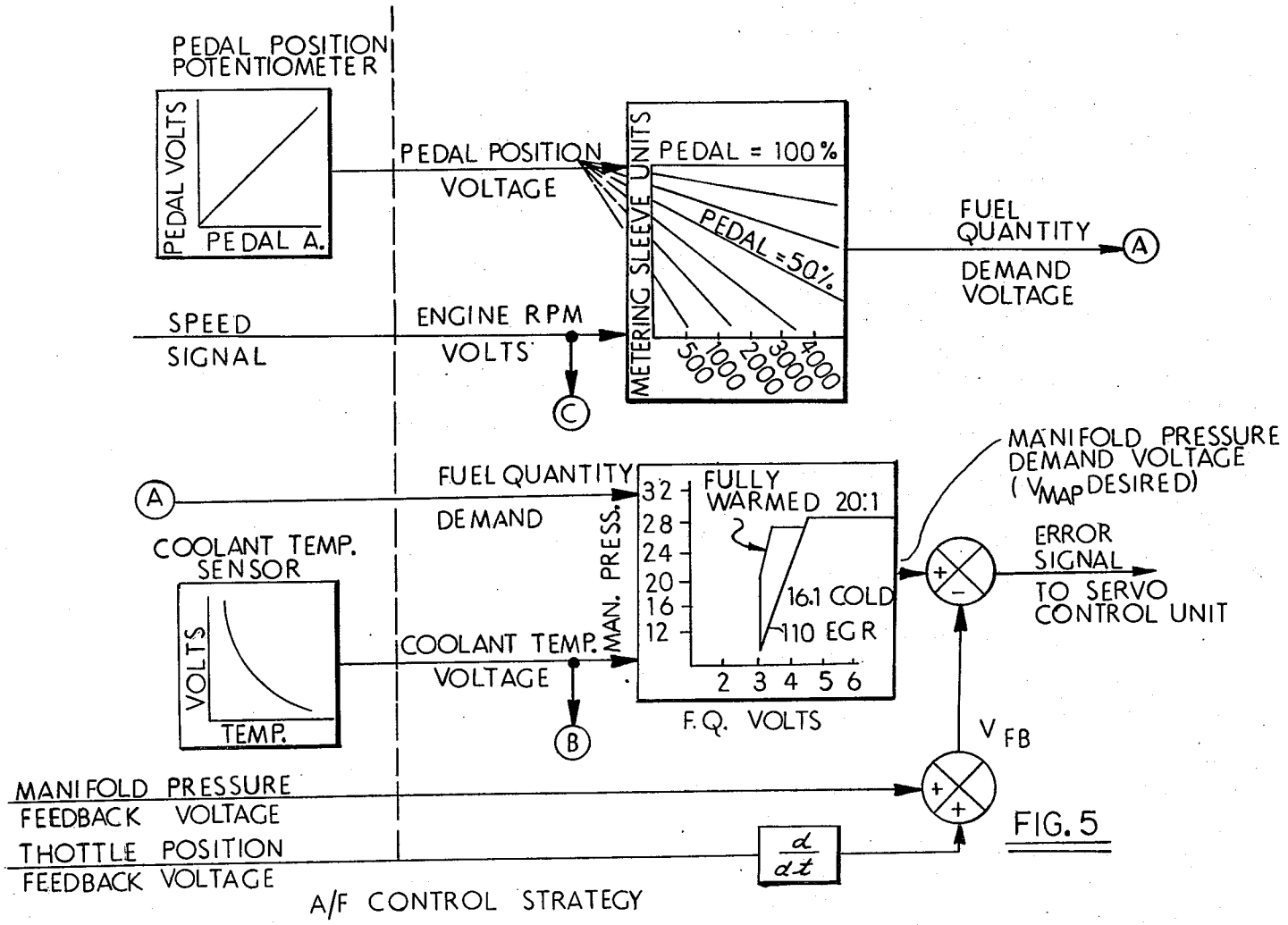
FIG. 5 is the direct fuel control system for controlling air fuel strategy.
Figure 6:
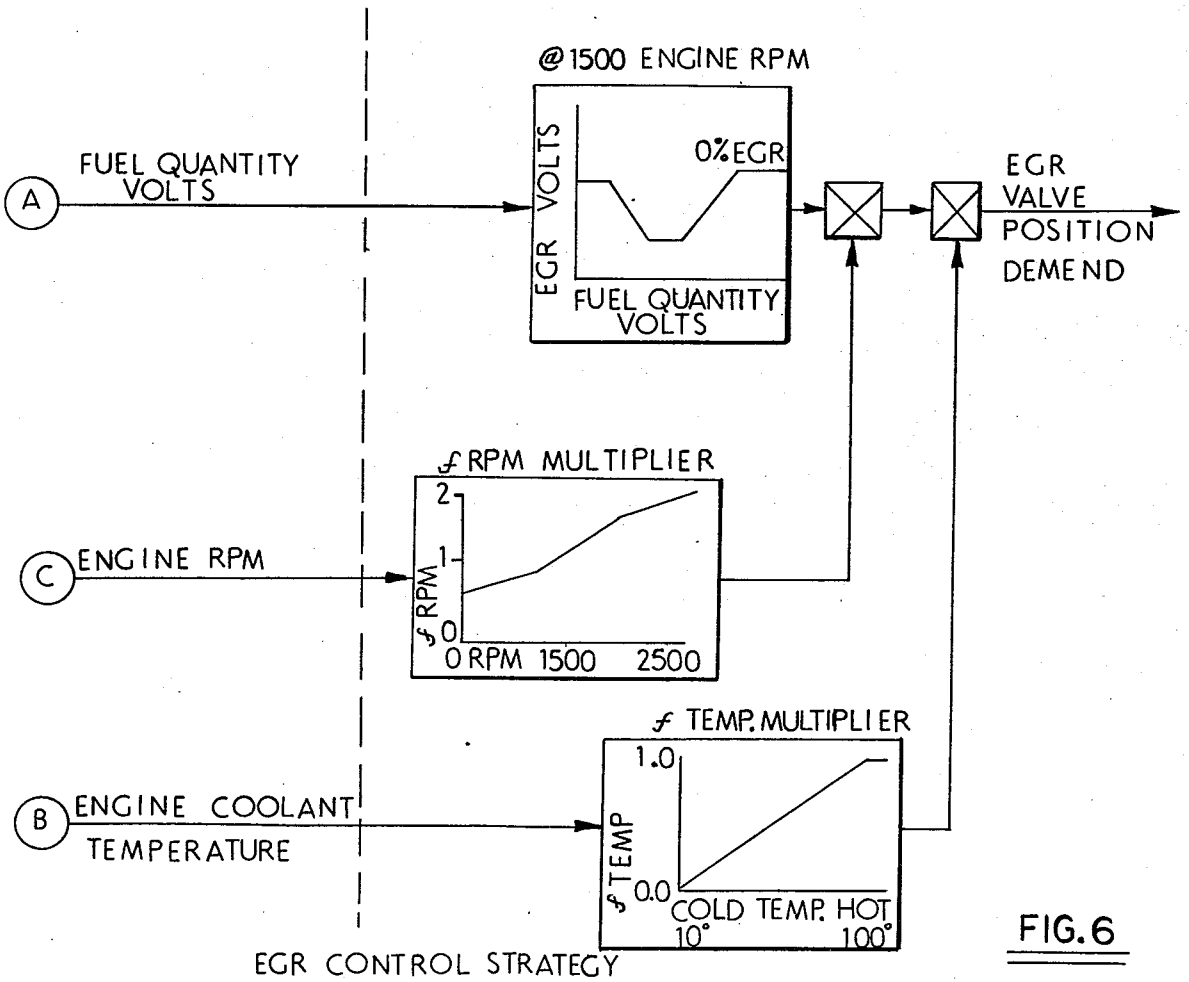
FIG. 6 is a direct fuel control block diagram for controlling exhaust gas recirculation strategy.

Referring to FIGS. 4, 5, and 6, there are shown block diagrams for control of ignition, air fuel and EGR, respectively, as implemented in a direct fuel control system.

The direct fuel control strategy can be divided into the following three regimes. First, a part throttle regime wherein the throttle position servo is controlled to produce proper manifold absolute pressure, depending on the fuel quantity demand, exhaust gas recirculation, and air fuel ratio. The second regime is wide open throttle wherein the exhaust gas recirculation goes to zero and the air fuel ratio is in the range of 20 to 1 to 16 to 1. In the second regime, the exhaust gas recirculation is decreased with increasing fuel quantity for increased torque. Third, when wide open throttle is at a steady state, the exhaust gas recirculation is equal to zero and torque increase is achieved by decreasing the air fuel ratio from about 16 to 1 to about 12 to 1 based on the fuel quantity signal.

FIG. 5 illustrates the calculation of a voltage representing a desired manifold absolute pressure. Engine coolant temperature is sensed so that a family of curves, representing different coolant temperatures, can be plotted on axes of fuel quantity (F.Q.) demand in volts and desired manifold absolute pressure. The fuel quantity demand voltage is determined as a function of pedal position and engine speed (r.p.m.).

In particular, in the first regime throttle position is stabilized against known manifold filling and pump down delay times by negative feedback of throttle velocity. In other words, stabilization is achieved by multivariable feedback of the manifold absolute pressure, which is the main control variable, and the actual throttle position, the velocity of which provides essential stabilization:

$$V_{FB} = G_1 V_{MAP\ ACTUAL} + G_2 \frac{d(V_{TH\ POS})}{dt}$$

Various modifications and variations will no doubt occur to those skilled in the arts to which this invention pertains. For example, this invention may be used in conjunction with various speed-density systems, including adaptive, for air fuel ratio control. These other systems also possess inherent and variable time delays and responses which, if not control stabilized by using the techniques described in this invention, can lead to unstable oscillatory behavior of the throttle valve. These and all other variations which basically rely on the teachings through which this disclosure has advanced the art are properly considered within the scope of this invention.

We claim:

1. A closed loop method of controlling a throttle in an internal combustion engine having an intake manifold and controlling air entering the engine as a function of engine operator controlled fuel demand, said method including controlling the throttle as a function of the rate of change of throttle position with respect to time, thereby stabilizing throttle response, and generating a control voltage for controlling throttle position to achieve a desired level of manifold absolute pressure, said control voltage being equal to the difference between a command voltage representing a desired manifold absolute pressure and a feedback voltage which is the sum of a first product of a first constant and a voltage representing actual manifold absolute pressure and of a second product of a second constant and a voltage representing throttle velocity.

2. A method of controlling a throttle as recited in claim 1 wherein said command voltage representing a desired manifold absolute pressure is determined as a function of demanded fuel quantity and engine coolant temperature.

3. A method of controlling a throttle as recited in claim 2 wherein throttle velocity is determined as a function of sensed throttle valve position.

4. A method as recited in claim 3 further comprising the steps of:

directly establishing the quantity of fuel desired;

establishing the desired amount of exhaust gas recirculation (EGR);

generating a voltage, $V_{MAP\ ACTUAL}$, indicative of actual intake manifold absolute pressure;

generating a voltage, $V_{TH\ POS}$, indicative of throttle position;

generating a voltage representative of a desired manifold absolute pressure, $V_{MAP\ DESIRED}$;

determining the engine speed (rpm);

applying inputs indicative of engine rpm, actual manifold absolute pressure and EGR valve position to an engine electronic control unit means for processing information;

generating in the electronic engine control unit means an EGR valve control command, a spark timing control signal, and a throttle position command signal; and adjusting the throttle in accordance with the throttle position command signal.

5. A method of controlling a throttle in an internal combustion engine having an intake manifold including the steps of:

generating a voltage, $V_{MAP\,ACTUAL}$, representative of actual manifold absolute pressure;

generating a voltage, $V_{TH\ POS}$, representative of throttle valve position;

generating a MAP command voltage representative of a desired manifold absolute pressure;

generating a feedback voltage representative of the sum of a first product of a first constant and $V_{MAP\ ACTUAL}$, and of a second product of a second constant and a voltage representative of the derivative, with respect to time, of $V_{TH\ POS}$;

generating a throttle position command voltage as a function of the difference between the MAP command voltage and the feedback voltage; and adjusting the throttle as a function of the throttle position command voltage.

6. An apparatus for controlling a throttle in an internal combustion engine having an intake manifold, said apparatus including:

a manifold absolute pressure sensor means for generating a voltage representative of actual manifold absolute pressure;

a throttle valve position sensor means for generating a voltage representative of throttle valve position;

an engine electronic control unit means coupled to said pressure sensor means and said position sensor means for generating a MAP command voltage representative of desired manifold absolute pressure and a feedback voltage representative of the sum of a first product of a first constant and the voltage representing actual manifold absolute pressure and of a second product of a second constant and a voltage representative of the derivative, with respect to time, of the voltage representative of throttle valve position;

a servo control unit means coupled to said engine electronic control unit means for generating a throttle position command voltage as a function of the difference between the MAP command voltage and the feedback voltage; and a throttle valve actuator means coupled to said servo control unit means for positioning the throttle as a function of the throttle position command voltage.

* * * * *